United States Patent [19]

Morrison

[11] Patent Number: 4,931,008

[45] Date of Patent: Jun. 5, 1990

[54] QUICK DISASSEMBLY SCREED CONSTRUCTION

[76] Inventor: Donald R. Morrison, 9900 Mt. Holly Rd., Charlotte, N.C. 28214

[21] Appl. No.: 293,458

[22] Filed: Jan. 4, 1989

[51] Int. Cl.[5] ..... E01C 19/38; B28B 1/08

[52] U.S. Cl. ..... 425/456; 403/44; 403/45; 403/287; 404/114; 404/119; 411/432; 425/458

[58] Field of Search ..... 425/456, 458; 404/96, 404/97, 98, 114, 119; 403/43, 44, 45, 46, 79, 157, 287; 264/69; 411/432, 436

[56] References Cited

U.S. PATENT DOCUMENTS

| | | | |
|---|---|---|---|
| 3,044,811 | 7/1962 | Niskin | 403/44 |
| 3,291,090 | 12/1966 | Sevey | 403/44 |
| 3,319,990 | 5/1967 | Beal | 403/157 |
| 4,025,208 | 5/1977 | Donahue | 403/157 |
| 4,034,946 | 7/1977 | Zimmer, Jr. | 403/157 |
| 4,261,694 | 4/1981 | Morrison | 425/456 |
| 4,340,351 | 7/1982 | Owens | 425/456 |
| 4,375,351 | 3/1983 | Allen | 425/456 |
| 4,449,845 | 5/1984 | Carrillo | 404/97 |
| 4,560,147 | 12/1985 | Bowdren | 403/43 |
| 4,701,071 | 10/1987 | Morrison | 404/114 |
| 4,836,485 | 6/1989 | Cooper | 403/157 |

FOREIGN PATENT DOCUMENTS

| | | | |
|---|---|---|---|
| 1072016 | 12/1959 | Fed. Rep. of Germany | 403/157 |
| 2552491 | 6/1976 | Fed. Rep. of Germany | 403/157 |

OTHER PUBLICATIONS

Webster's New Twentieth Century Dictionary, Second Edition (1971) Title page, copyright page, p. 1972.

Webster's Ninth New Collegiate Dictionary (1986)–Title page, copyright page, p. 1273.

A Manual of Engineering Drawing for Students & Draftsmen (1960) Title page, copyright right page, p. 343.

Mechanical Engineer's Handbook (1951)–Title page, copyright page, p. 1577.

*Primary Examiner*—James C. Housel

*Assistant Examiner*—K. P. Nguyen

*Attorney, Agent, or Firm*—Olive & Olive

[57] ABSTRACT

A vibrating portable screed of the type made up of sections having screed blade means at the base and a ridge portion at the top employs a turnbuckle assembly in the ridge portion held together by a removable pin and other removable pin connected means in the base portion thereby enabling the sections to be quickly assembled and disassembled by installing and removing the pins.

6 Claims, 4 Drawing Sheets

QUICK DISASSEMBLY SCREED CONSTRUCTION

BACKGROUND OF THE INVENTION

1. Field of Invention

This invention relates to portable vibrating concrete screeds, to the construction of screed frames and particularly to means for connecting screed frame sections together.

2. Background Art

Portable vibrating screed frames are typically made up of sections which are connected together. The tops or ridge portions of the sections are connected together by a single turnbuckle screwed onto left and right handed threaded members extending from each section. The screed blades at the bottom of the sections are bolt connected together by various types of angle plates or tangs which permit the sections to be angled relative to each other when the turnbuckle connection is adjusted so as to selectively form level, valley or crown type surfaces. U.S. Pat. No. 4,253,778, 4,340,351, 4,375,351 and 4,701,071 illustrate various types of portable screeds made up of sections connected together in the manner described. The screed blades are typically vibrated by a shaft as in U.S. Pat. No. 4,253,778, by air vibrators as in U.S. Pat. No. 4,261,694 or by electric vibrators.

Portable screeds of the type described frequently have to be taken apart to move from one job to another, to move to a different location on the same job site or for repair. Considerable time and several different types of wrenches are required to disconnect the screed blades and turnbuckle and the vibrating shaft when used as the source of vibration. Thus, the present invention has as its primary object to reduce this time and simplify this operation. Other objects will become apparent as the description proceeds.

SUMMARY OF INVENTION

A portable screed frame according to the invention utilizes a turnbuckle at the top of the frame made up of right and left handed internally threaded parts joined by a hammered in drift pin which can be easily removed and installed to break the turnbuckle apart. When the two parts are joined by the pin, the turnbuckle operates as an integral single turnbuckle. At the base of the frame, other drift pins are used with hammered in drift pin connectors arranged such that the frame sections can be taken apart where the screed blade of one section is joined to the other simply by hammering in or knocking out one or more drift pins. When a vibrating shaft is employed, a fastening pin with a hairpin clip is employed to join the shaft of one screed section to the shaft of another screed section. Fastening pins with hairpin clips may also be employed in place of the hammered in drift pins.

DESCRIPTION OF THE PREFERRED EMBODIMENT

Figure 1:
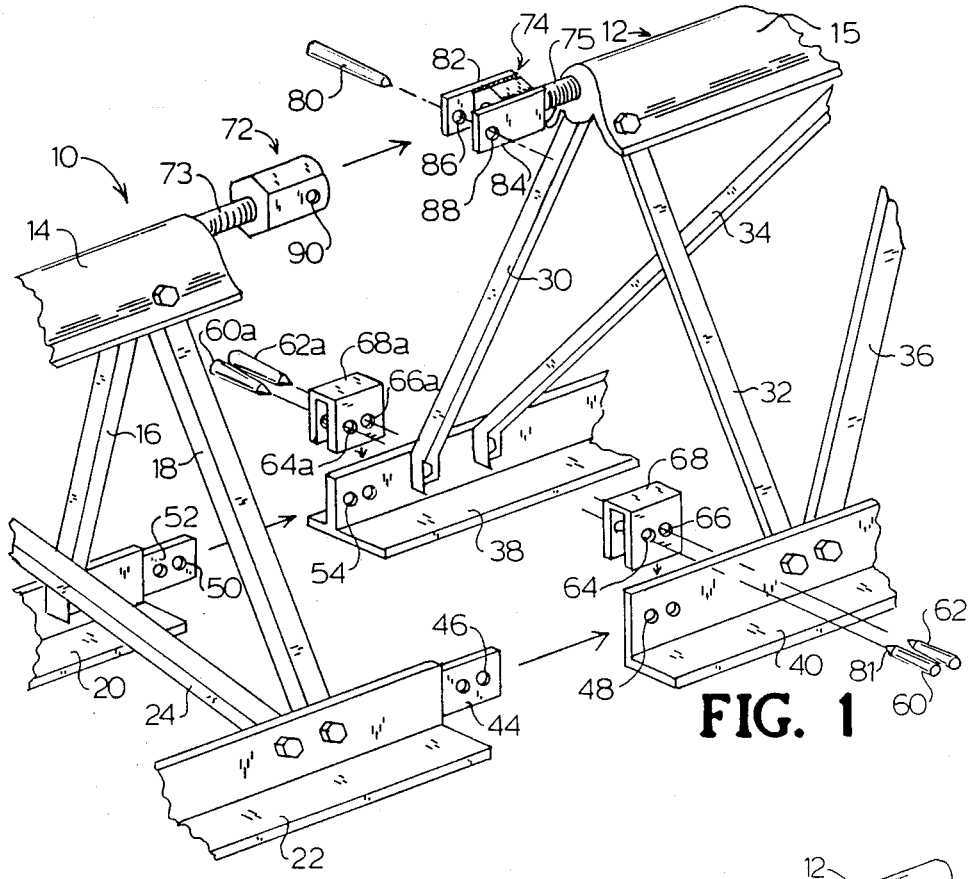
FIG. 1 is a perspective and exploded view of portions of two portable screed frame sections fitted for quick disassembly according to the invention and showing in a first embodiment a first type of screed blade connection. Cross braces and the vibrating source are not shown to simplify the drawings.
Figure 2:
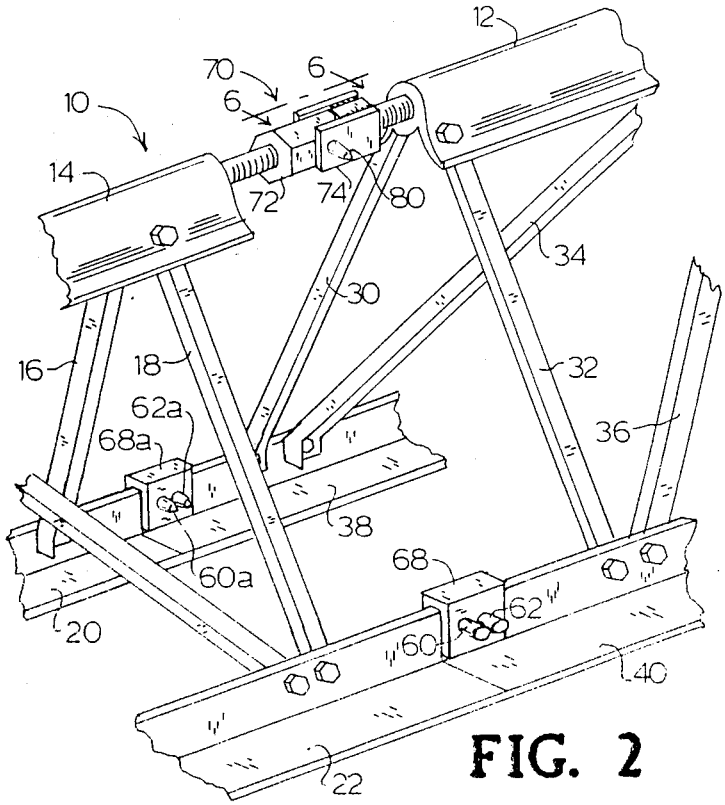
FIG. 2 is a perspective view of the portions of two portable screed frame sections shown in FIG. 1 fitted together according to the invention but prepared for quick disassembly.

Referring to FIG. 1, there is shown portions of two sections of a portable screed comprising section 10 and section 12. Section 10 includes a ridge tube 14 bolted to side braces 16, 18 which are in turn bolted to screed blades 20, 22 with a portion of another side brace 24 being shown. The source of vibration and the usual cross braces between the blades 20, 22 are not shown. Section 12 is of similar construction having side braces 30, 32, 34, 36 bolted to ridge tube 15 and blades 38, 40. In this example, blade 22 connects to blade 40 by means of a tang 44 having fastener holes 46 which mate with fastener holes 48 in blade 40. In a similar manner, fastener holes 50 in tang 52 mate with fastener holes 54 in blade 38. As seen in FIGS. 1 and 2, once the mentioned holes are aligned, tapered drift pins 60, 62 are hammered in and driven through holes 64, 66 of an inverted U-shaped clip 68 in the manner illustrated in FIG. 2 thus facilitating ease of assembly and disassembly of the screed blades of two adjoining sections. Another pair of tapered drift pins **60*a*, 62*a* are hammered in a similar clip 68*a* to join screed blades 20 and 38 as in FIG. 2. The tapered drift pins preferably each have a pointed end 81 (FIG. 1**) and the hole sizes are selected for a tight frictional fit.

Figure 6:
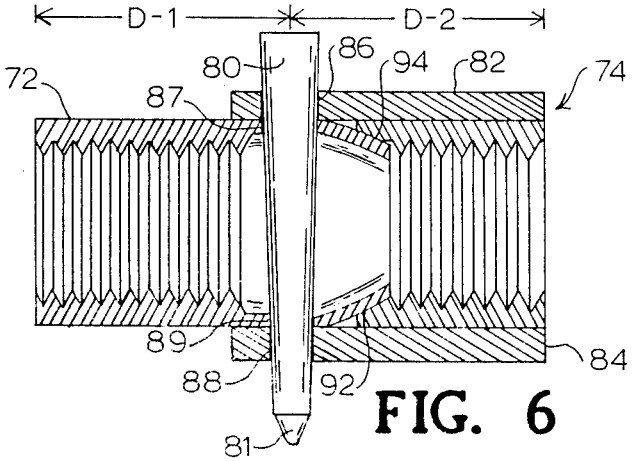
FIG. 6 is a cross section of the modified turnbuckle assembly of the invention taken along line 6—6 of FIG. 2.

The turnbuckle assembly 70 comprises what will be referred to as a right threaded sleeve portion 72 on threaded member 73 and a left portion 74 on threaded member 75 one portion having left threaded sleeve handed threads and the other right handed threads. Threaded members 73, 75 are secured in the respective ridge members 14, 15. However, it is recognized that the threaded members 73, 75 could be secured in the respective turnbuckle portions 72, 74 and threaded into the respective ridge tubes 14, 15. The two threaded sleeve portions 72, 74 are joined by means of a tapered drift pin 80 which passes through a pair of plates 82, 84 welded to portion 74 and having opposed holes 86, 88 arranged to align with hole 90 in portion 72 when the parts are assembled as in FIG. 2. The holes 86, 88 and 90 which receive pin 80 are located such that distances D-1 and D-2 (FIG. 6) are substantially equal. The interior of portion 74 at the end which joins portion 72 has a female tapered surface 92 and the exterior surface of portion 72 is formed with a male tapered surface 94 which facilitates the join. Pin entry hole 86 in plate 82 is preferably larger than the pin exit hole 88 in plate 84 and pin entry hole 87 in portion 72 is preferably larger than pin exit hole 89 in portion 72 to facilitate a tight grip.

Figure 3:
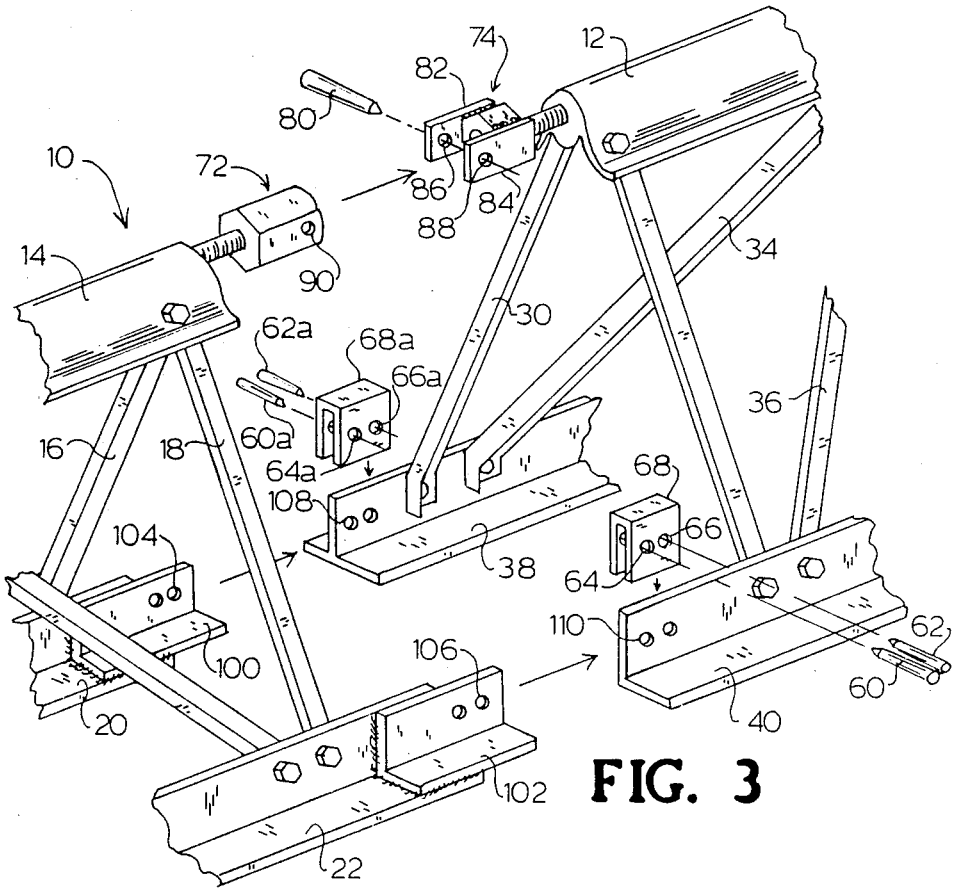
FIG. 3 is a perspective and exploded view of portions of two portable screed frame sections fitted for quick disassembly according to the invention and showing in a second embodiment a second type of screed blade connection.

The construction of FIG. 3 is similar to that of FIGS. 1 and 2 except that instead of tangs 44, 52 of FIG. 1, a pair of angle plates 100, 102 welded to blades 20, 22 with respective holes 104, 106 mate with corresponding holes 108, 110 to receive drift pins **60, 62, 60*a* and 62*a*. Clips 68, 68*a*** work in the manner previously explained.

Figure 4:
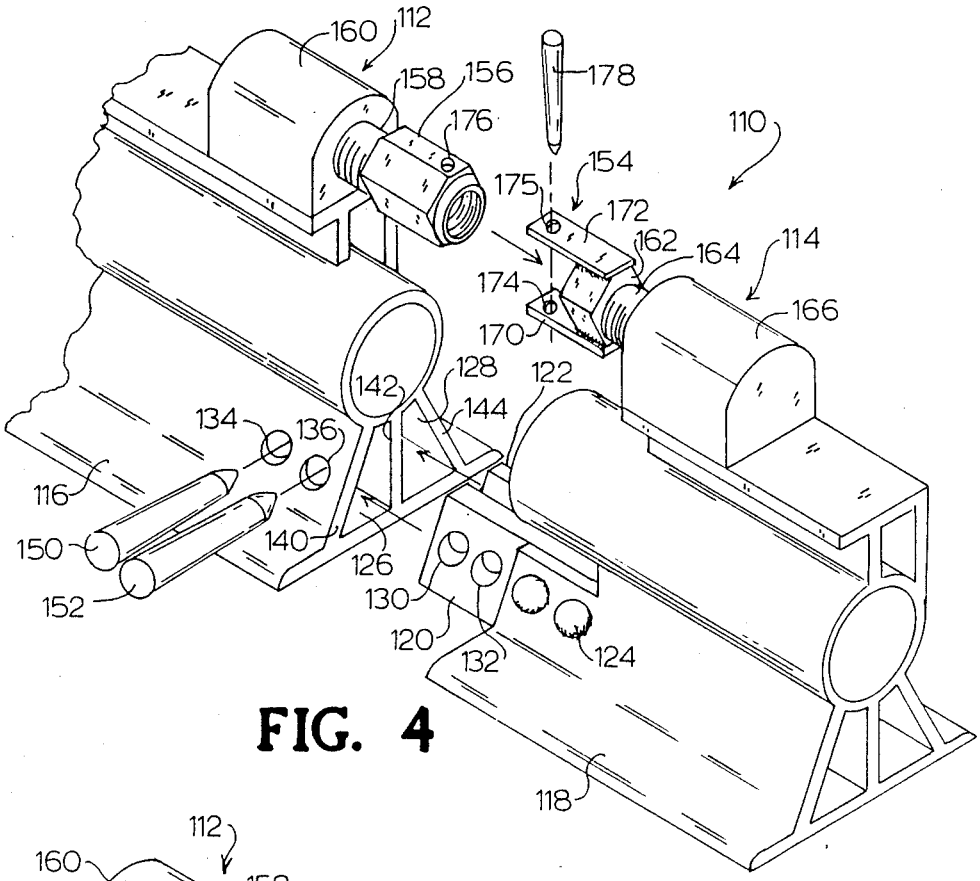
FIG. 4 is a perspective and exploded view of two portable screed frame sections fitted for quick disassembly according to the invention and showing in a third embodiment a third type of screed blade connection.
Figure 5:
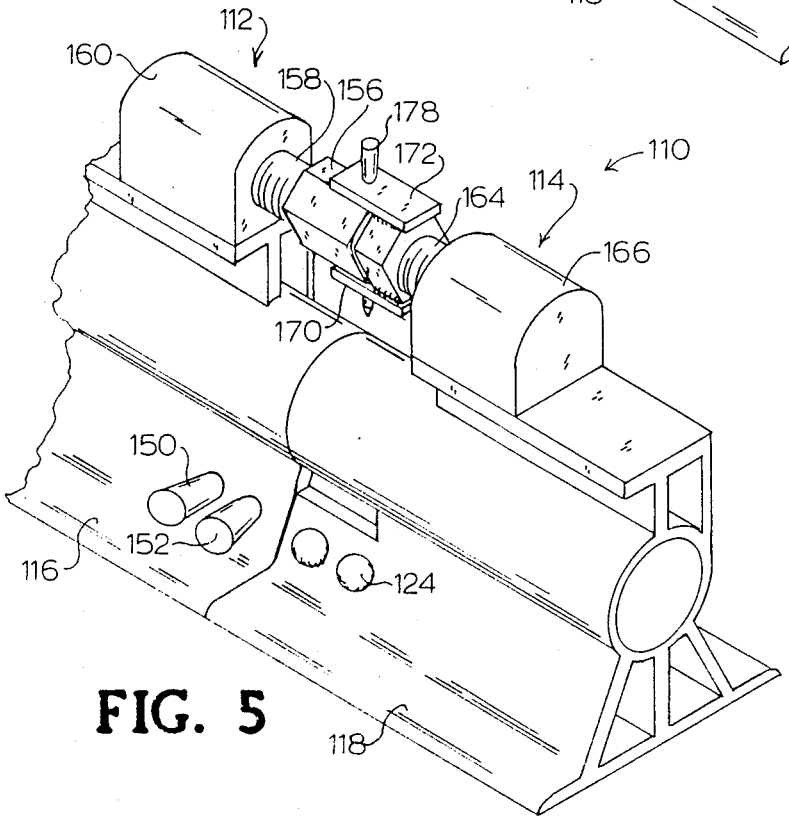
FIG. 5 is a perspective view of the portions of two portable screed frame sections shown in FIG. 4 fitted together according to the invention but prepared for quick disassembly.

Versatility of the invention is further illustrated in FIGS. 4 and 5 in which the frame construction of U.S. Pat. No. 4,701,071 is modified according to a third embodiment of the invention. In this embodiment, the screed structure 110 comprises a pair of extruded sections 112, 114 with mating screed blades 116, 118. Section 112 is joined to section 114 by means of a pair of tangs 120, 122 secured to section 114 by rivets 124. Tangs 120, 122 enter the cavities 126, 128 of section 112 to bring the holes 130, 132 which pass through tangs 120, 122 in alignment with holes 134, 136 which pass through the ribs 140, 142, 144 of section 112. Thus, when section 112 is connected to section 114, hole 130 is brought into alignment with hole 134 and hole 132 is brought into alignment with hole 136 thus permitting the tapered drift pins 150, 152 to be hammered in to releasably secure the two sections together as illustrated in FIG. 5. Hole sizes are selected as previously described to assure a tight frictional fit of the pins in service.

The FIG. 4 embodiment utilizes a turnbuckle assembly 154 having a portion 156 threadably secured on threaded rod 158 extending from block 160. In a similar manner, turnbuckle portion 162 mounts on threaded rod 164 mounted on block 166. Turnbuckle portion 162 is welded to two plates 170, 172 provided with respective holes 174, 175 which pass through the plates and are adapted to mate with a hole 176 passing through portion 156 so as to receive a hammered in tapered drift pin 178 in the manner previously described and as shown in FIG. 5 in a secured position. Thus, the screed sections 112, 114 are assembled by bringing the sections together and hammering in the respective drift pins 150, 152 and 178 and are disassembled by hammering out such drift pins thus greatly simplifying the ease of assembly and disassembly.

Figure 7:
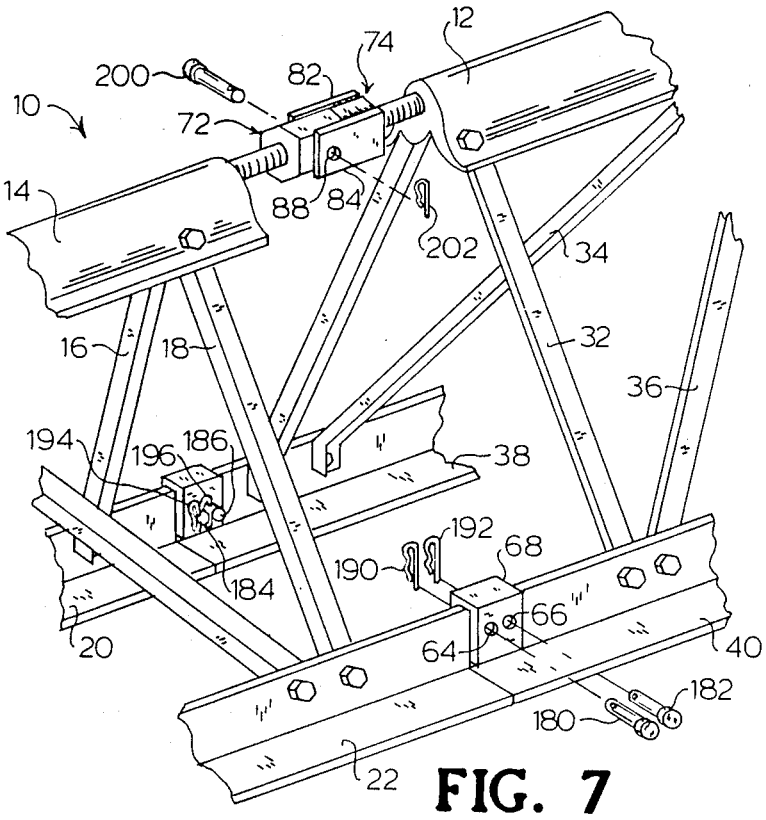
FIG. 7 is an illustration of a portion of the frame sections of FIG. 1 fitted with a pair of pin and mating hairpin clip type fasteners in place of the drift pins shown in FIG. 1.

FIG. 7 to which reference is next made is identical to FIG. 2 except for the provision of clip pins 180, 182, 184 and 186 and corresponding retaining hairpin clips 190, 192, 194 and 196 which are used in a conventional manner in place of the tapered drift pins to retain the screed blades of the two screed sections together. A comparable clip pin 200 and hairpin clip member 202 are employed to retain the turnbuckle assembly together in place of the tapered drift pins in the manner previously described.

Figure 8:
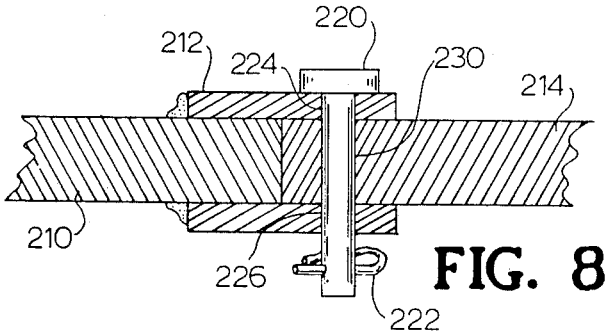
FIG. 8 illustrates in cross section the manner of joining two shaft members for quick disassembly when a vibrating shaft is used as the source of vibration.

To complete the description, ease of assembly and disassembly is further facilitated for the vibrating shaft type of screed such as shown in U.S. Pat. No. 4,253,778. Referring to FIG. 8, one vibrating shaft 210 part of one screed section mounts a welded on hollow tube 212 into which the mating vibrating shaft 214 is received. The, two shaft sections are then secured by a clip pin 220 having a hairpin clip 222 as seen in FIG. 8 which passes through mating holes 224, 226 formed in tube 212 and hole 230 formed in shaft 214.

It can thus be seen that assembly and disassembly requires only a hammer if tapered drift pins are employed with the invention construction and no tools if clip pins or the like are employed with the invention construction.

What is claimed is:

1. A vibrating concrete screed comprising:

(a) an elongate frame having first and second sections each having a top ridge portion and a base portion;

(b) screed blade means mounted on each section base portion adapted to engage and level concrete as the screed is moved over the concrete;

(c) quick disassembly means having one or more removable pins for joining the base portion of one section including the screed blade means thereon to the base portion of the other section including the screed blade means thereon; and (d) a quickly disassembled turnbuckle assembly made up of two threaded sleeve portions one of which is threadedly engaged with a right handed threaded member extending from the ridge portion of one section and the other sleeve portion is threadedly engaged with a left handed threaded member extending from the ridge portion of the other section and means including a removeable pin for joining one threaded sleeve portion to the other threaded sleeve portion such that when joined the two threaded sleeve portions operatively form a single threaded sleeve and the assembly performs as a single turnbuckle assembly enabling the angle of one screed section relative to the other screed section to be adjusted and when quick disassembly is desired said assembly removeable pin may be removed enabling said threaded sleeve portions to separate to break apart the assembly.

2. A vibrating concrete screed as claimed in claim 1 wherein said screed blade means comprises a pair of screed blades mounted on each said section.

3. A vibrating concrete screed as claimed in claim 1 wherein said screed blade means comprises a single screed blade on each said section.

4. A vibrating concrete screed as claimed in claim 1 wherein one threaded sleeve portion of said turnbuckle assembly includes a hole passing therethrough and the other threaded sleeve portion of said turnbuckle assembly includes a pair of opposed plate members joined thereto with opposed holes adapted to mate with the hole of said one threaded sleeve portion for receiving said assembly removeable pin.

5. A vibrating screed as claimed in claim 1 wherein said base portion and turnbuckle assembly removeable pins comprise hammered in tapered drift pins which frictionally engage to maintain the sections together.

6. A vibrating screed as claimed in claim 1 wherein said base portion and turnbuckle assembly removeable pins are secured by removeable clips passing therethrough.

* * * * *